United States Patent [19]

Hara

[11] Patent Number: 5,025,637

[45] Date of Patent: Jun. 25, 1991

[54] AUTOMATIC ICE MAKING MACHINE

[75] Inventor: Yasuo Hara, Toyoake, Japan

[73] Assignee: Hoshizaki Denki Kabushiki Kaisha, Aichi, Japan

[21] Appl. No.: 510,118

[22] Filed: Apr. 16, 1990

[51] Int. Cl.[5] ..... F25C 1/12

[52] U.S. Cl. ..... 62/138

[58] Field of Search ..... 62/138, 233, 126

[56] References Cited

U.S. PATENT DOCUMENTS

| | | | |
|---|---|---|---|
| 3,969,097 | 7/1976 | Braden | 62/138 X |
| 4,238,930 | 12/1980 | Hogan et al. | 62/138 |
| 4,344,295 | 8/1982 | Linstromberg | 62/233 X |
| 4,601,176 | 7/1986 | Suyama | 62/138 |
| 4,938,030 | 7/1990 | Josten et al. | 62/138 X |

*Primary Examiner*—William E. Tapolcai
*Attorney, Agent, or Firm*—Koda & Androlia

[57] ABSTRACT

Disclosed is an automatic ice making machine having an ice making section, a water feed system, an ice releasing unit and an ice removal detector; characterized in that said ice making machine further comprises a protection unit which stops the ice making operation after a predetermined time counted from the starting point of the ice releasing operation, provided that the ice removal detector outputs no ice removal signal. The protector unit may have an alarm means which is actuated when the ice making operation is suspended for some reasons, or the protector unit may comprise a timer having a normally open contact which is closed when a preset time is counted up thereby, a normally closed contact interposed within one of the power supply lines connected to the ice making machine, and a relay having a normally open contact disposed parallel to the normally open contact of the timer; wherein the relay allows its normally closed contact to assume an open posture when the normally open contact of the timer is closed to simultaneously allow its normally open contact to assume a closed posture to retain continuity on its own.

8 Claims, 3 Drawing Sheets

AUTOMATIC ICE MAKING MACHINE

BACKGROUND OF THE INVENTION

This invention relates to an automatic ice making machine, more particularly to an automatic ice making machine equipped with a protection unit which can effectively prevent compressor burning and waste of power during ice making operation.

Various types of automatic ice making machines for continually making various shapes of ice cakes including cube and plate in large quantities are utilized suitably depending on the applications. For example, popular ice making machines include:

(1) so-called closed cell system ice making machines having a multiplicity of freezing cells opening downward formed in a freezing chamber, in which the freezing cells can separably be closed with a water tray, and a water for freezing is injected into the freezing cells through the water tray to form ice cubes gradually therein;

(2) so-called open cell system ice making machines having a multiplicity of freezing cells opening downward, in which a water to be frozen is directly injected into the freezing cells in the absence of the water tray to form ice cubes in the freezing cells; and (3) flow-down system ice making machines having a tilted freezing plate, in which a water to be frozen is supplied to flow on the upper or lower surface of the freezing plate to form an ice plate on the corresponding surface.

These automatic ice making machines generally have an ice making mechanism in the upper part of the machine body and a freezing system for cooling said ice making mechanism at the lower part thereof, said freezing system comprising a compressor, a condenser, a capillary tube, an evaporator, etc.

The evaporator connected to this freezing system is disposed at the ice making section in the ice making mechanism to cool the ice making section; whereas a water to be frozen is circulably fed to the ice making section being cooled to form ice cakes, and upon detection of the growth of the ice cakes to a predetermined size by an ice formation detector which detects completion of ice formation, feeding of the water to be frozen is stopped. Subsequently, by the selective operation of a valve, a heated gaseous cooling medium from the compressor is adapted to be fed through a bypass tube to the evaporator to heat the ice making section and allow the ice cakes formed therein to drop by their own weight, whereby the ice cakes thus released are collected and accumulated in a stocker disposed below the ice making section. Incidentally, a fin and tube type condenser is generally used as the condenser of the freezing system which is forced to be cooled by a cooling fan.

As described above, a heated gaseous cooling medium is directly fed to the evaporator during the ice releasing operation, wherein the condensing power of the condenser is generally lowered for the purpose of preventing the liquid phase cooling medium to stay in the condenser and also increasing the internal pressure within the freezing system circuit. Further, the heating of the evaporator is accelerated by increasing the amount of the circulating gaseous cooling medium.

As a way of lowering the condensing power of the condenser, it is generally performed to stop operation of the air cooling fan motor therefor in an air cooling system condenser, whereas to stop supply of cooling water in a water cooling system condenser.

On the other hand, in order to detect completion of the ice releasing operation, the following methods are generally employed:

(1) a temperature detector comprising a temperature element such as thermistor disposed, for example, on the side wall of the freezing chamber is allowed to monitor the sudden temperature rise which is observed when the ice cakes formed in the freezing chamber are released or drop, and completion of the ice releasing operation can be detected upon detection of temperature rise to a predetermined level by the temperature detector; or (2) a detection member comprising a rod and the like disposed on the way that the ice cakes released from the freezing chamber slide down into an ice reservoir and the like so that the ice cakes may hit the detection member to shift its position, and a microswitch is allowed to be depressed and actuated by the shifting of the detection member, whereby completion of the ice making operation can be detected.

In the conventional automatic ice making machine described above, when the ice formation detector is rendered out of order or rendered incapable of detecting completion of ice formation during the ice releasing operation for some reasons, the ice releasing operation is continued even after the ice cakes are actually released completely to cause the following problems:

(1) if the ice releasing operation is continued, the temperature of the freezing chamber having released the ice cakes continues to rise rapidly to make the cooling medium to be sucked into the compressor through a suction pipe from the evaporator on the freezing chamber remain as a heated gaseous phase, so that not only the internal temperature of the compressor in the freezing system rises rapidly but also the temperature of the gaseous cooling medium discharged from the compressor further rises. Accordingly, the compressor performs an overload operation due to the rise in the internal pressure within the freezing system circuit and the rise in the internal temperature of the compressor, to increase the motor current and overheat the compressor case; and (2) an overload protection unit generally disposed for the compressor is designed to be actuated when the temperature of the compressor case is elevated beyond the predetermined level to shut off the power supply to the compressor and stop the operation thereof. However, if the compressor is stopped, the pressure of the cooling medium within the freezing system circuit gradually drops and the temperature of the compressor itself is gradually lowered due to natural heat dissipation, so that the overload protection unit of the compressor is automatically reset to resume energization of the compressor and thus the overload operation. Then, the overload protection unit is actuated again to repeat the cycle of stopping and overload operation.

Namely, when the ice releasing operation is continued as the result of failure in detecting completion of ice releasing operation, the compressor repeats the overload operation and stopping alternatively unless the user recognizes it to take some measures. This overload operation causes not only waste of power but also deterioration of lubrication oil in the rotary section of the compressor. If the lubrication oil is thus deteriorated, smooth movement of the sliding section is inhibited to accelerate abrasion, leading to burning of the compressor itself to cause locked state or burning of the motor. Further, problems occur that the ice cakes in the ice reservoir melt due to the overheating of the freezing chamber and that the members disposed adjacent to the freezing system undergo deformation or burning. Moreover, the continued ice releasing operation causes the water to be frozen to be kept supplied from the external water supply system to the water feeding system to waste enormous amount of the water.

On the other hand, if the solenoid valve which performs selective operation of opening/closing the bypass tube for some reasons including burning, the following problems arise: if the solenoid valve is incapable of performing the selective operation to open the bypass tube even after the ice releasing operation is started, the heated gaseous cooling medium cannot flow into the evaporator through the bypass tube but only through the capillary tube. Accordingly, the cooling medium is evaporated at a low temperature in the evaporator like in the ice making operation to cool the freezing chamber, so that the ice cakes cannot be released from the freezing chamber with the ice releasing operation being continued to waste power and water.

This invention has been proposed in view of the problems inherent in the conventional automatic ice making machines as described above and for the purpose of overcoming them successfully, and is directed to provide an automatic ice making machine equipped with an inexpensive protection unit which can prevent compressor burning and waste of power and water.

SUMMARY OF THE INVENTION

As has been described above, according to the automatic ice making machine of this invention, since a protection unit disposed therein causes the ice making machine to stop or causes the alarm unit to be actuated, if the ice releasing operation is not completed within a predetermined time counted after the starting point of the ice releasing operation, the ice making machine can securely be stopped when any trouble should occur such as defective opening operation of the hot gas valve; rotation trouble in the actuator motor in the direction for causing the resetting motion; trouble in the closing of the contact of the temperature detector; hot gas feeding trouble due to the gas leakage within the freezing system circuit; defective operation in condensing the cooling medium due to the trouble of the compressor, etc. The alarm unit is actuated whenever a trouble occurs, so that waste of power or water, fatal damage of the compressor can be prevented. Since there is no need of disposing various protection units to cope with the different types of troubles respectively, the automatic ice making machine of this invention can be manufactured at a low cost and allows easy maintenance.

BRIEF DESCRIPTION OF THE DRAWINGS

The attached drawings show a preferred embodiment of the automatic ice making machine according to this invention, wherein.

PREFERRED EMBODIMENT OF THE INVENTION

This invention will be described below more specifically by way of a preferred embodiment referring to the attached drawings.

Figure 1:
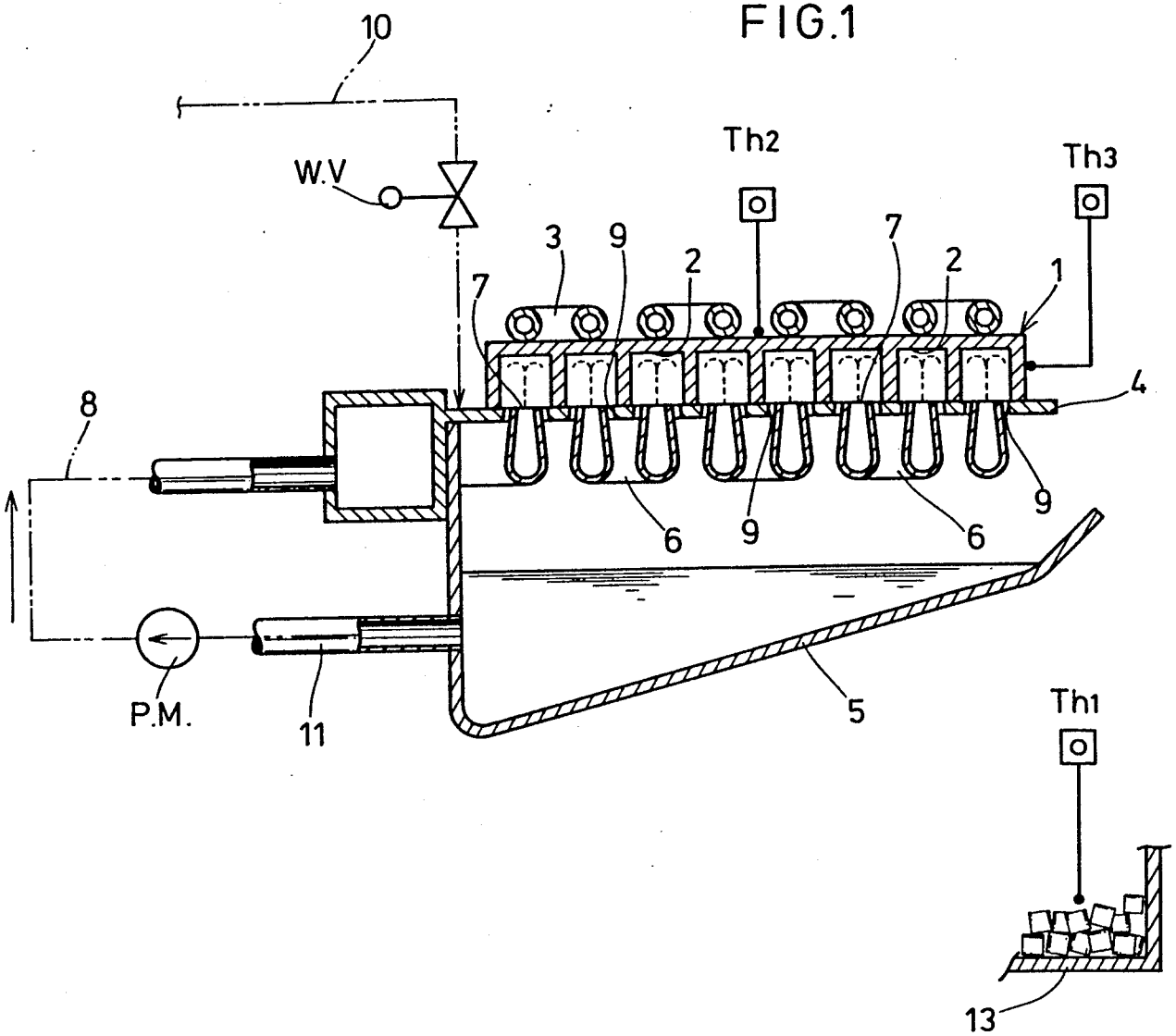
FIG. 1 shows schematically a constitution of a preferred embodiment of the automatic ice making machine according to this invention.

FIG. 1 shows an example of the automatic ice making machine in which the present invention can suitably be embodied. The automatic ice making machine has a freezing chamber 1 with a multiplicity of freezing cells 2 opening downward defined therein, and an evaporator 3 connected to the freezing system is disposed on the external upper wall surface of the freezing chamber 1. A water tray 4 is also disposed tiltably below the freezing chamber 1 to normally close the freezing cells 2 upwardly into a horizontal posture. The water tray 4 is supported pivotally at one end portion by means of a pivot not shown and forced to be tilted by an actuator during the ice releasing operation to allow the freezing cells 2 to be open. On the lower surface of the water tray 4, a distribution pipe 6 is disposed for feeding the water to be frozen into each freezing cell 2, and further a water tank 5 is disposed below the water tray 4. A predetermined amount of water to be frozen necessary for one cycle of ice making operation is fed into the tank 5 through a water feed valve WV from the external water supply system 10.

The water within the water tank 5 is fed out from a lower position thereof through a water feed pipe 11 and a pump PM to the distribution pipe 6 and injected into each of the freezing cells 2 through multiplicity of water injection holes 7 formed in the water tray 4 correspondingly with the freezing cells 2. The water to be frozen is partly frozen onto the internal wall surface of each freezing cell 2, and the unfrozen water is fed back to the water tank 5 through water discharge holes 9 defined, on the water tray 4, adjacent to the respective water injection holes 7. The water to be frozen is circulated through the water feed system 8 having such constitution to allow ice layers to grow gradually in the freezing chamber 1.

On the external upper wall surface of the freezing chamber 1, a temperature detector $Th_2$ comprising a temperature element such as thermostat and thermistor is closely disposed. The temperature detector $Th_2$ is designed to detect the temperature of the freezing chamber 1 and to be actuated to complete the ice making operation when the ice cakes in the freezing cells 2 grow fully to lower the temperature of the freezing chamber 1, and then it causes to start another cycle of ice releasing operation.

Incidentally, while completion of the ice formation is detected by the temperature detector $Th_2$ in this embodiment, other methods of detecting completion of ice formation, for example, by using a transducer for detecting the change in the water pressure in the distribution pipe 6 which occurs as the ice cakes grow, or by the change in the water level in the water tank 5, or by the thickness of the ice plate which has grown to a predetermined level, and the like can be employed.

In the automatic ice making machine shown in FIG. 1, the pump PM is stopped when ice releasing operation is started to stop feeding of the water to be frozen, and the water tray 4 and the water tank 5 are tilted to a predetermined angle under the operation of the actuator not shown to discharge the unfrozen water remaining in the water feed system 8 completely. By the selective operation of the valve, a hot gas is fed into the evaporator 3 connected to the freezing system to warm the freezing chamber 1, so that the ice cakes formed in the freezing cells 2 may drop by their own weight to be guided into the ice reservoir 13.

The completion of dropping of the ice cakes into the ice reservoir 13 is detected by a temperature detector $Th_3$ comprising a temperature element such as thermistor closely disposed on the external side wall surface of the freezing chamber 1 upon detection of the temperature rise in the freezing chamber 1. After detection of the completion of dropping of the ice cakes, the actuator is driven reversely to return the water tray 4 and the water tank 5 to the original horizontal position and close the freezing cell 2 upwardly, whereupon another portion of fresh water to be frozen is supplied into the water tank 5 through the water feed valve WV from the external water supply system 10. The pump PM then starts feeding the water to be frozen into the freezing chamber 1, and the ice making operation is resumed.

The mark $Th_1$ in FIG. 1 shows an ice fullness detector switch disposed in the ice reservoir 13, which assumes a closed posture when the ice reservoir 13 is empty to start the ice making operation, while it assumes an open posture when a predetermined amount of ice cakes are stored in the ice reservoir 13 to stop the ice making machine.

Figure 2:
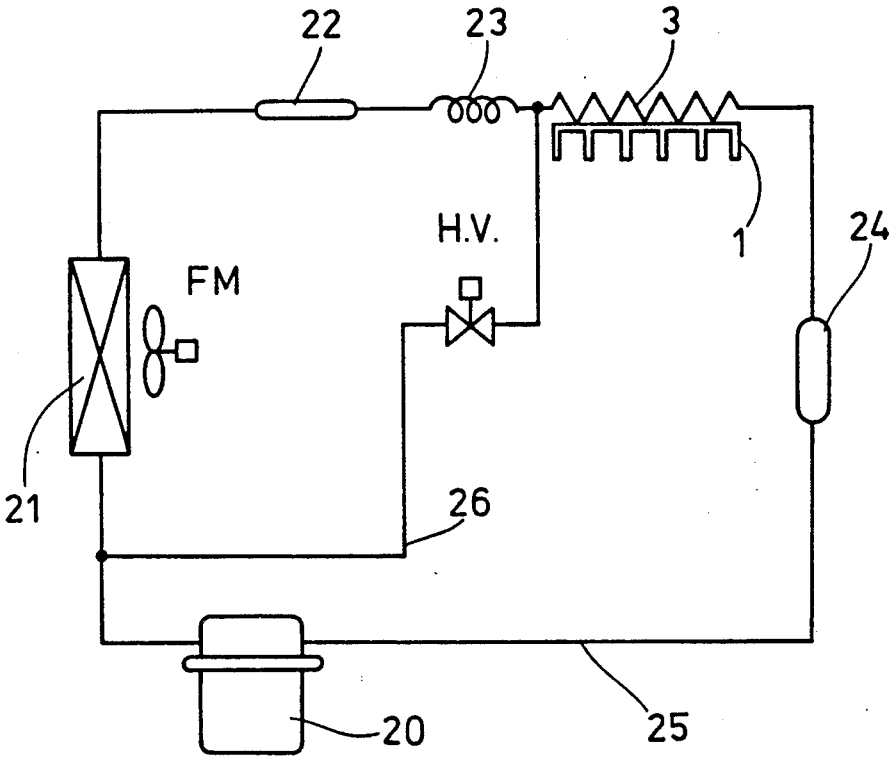
FIG. 2 shows a schematic diagram of the freezing system of the automatic ice making machine according to the embodiment.

FIG. 2 shows schematically a constitution of the freezing system. The gaseous cooling medium compressed in a compressor 20 is condensed in a condenser 21 and liquefied. After desiccation in a dryer 22, the liquefied cooling medium is subjected to pressure reduction through a capillary tube 23 and then to evaporation in the evaporator 3 disposed on the external upper wall surface of the freezing chamber 1. Upon heat exchange of the cooling medium with the water to be frozen injected into the respective freezing cells 2, the water is allowed to be frozen within the respective freezing cells 2. The gasified cooling medium in the evaporator 3 and the liquid cooling medium remaining ungasified flow into an accumulator 24 as a gas-liquid mixture, where they are separated into the respective phases; the gaseous phase cooling medium is fed back to the compressor 20 through a suction pipe 25, whereas the liquid phase cooling medium remains in the accumulator 24. Incidentally, the mark FM in FIG. 2 shows a fan motor for the condenser 21.

A hot gas pipe 26 branched from the discharge side of the compressor 20 communicates to the charge side of the evaporator 3 through a hot gas valve HV. The heated cooling medium discharged from the compressor 20 during the ice releasing operation flows into the evaporator 3 through the hot gas pipe 26 and the hot gas valve HV to warm the freezing chamber 1 and in turn the spherical surfaces of the ice cakes formed in the respective freezing cells 2 so that they may drop by their own weight. The heated cooling medium flowed out of the evaporator 3 then flows into the accumulator 24 to heat and evaporate the liquid phase cooling medium staying therein, which is fed back as the gas phase through the suction pipe 25 to the compressor 20.

Figure 3:
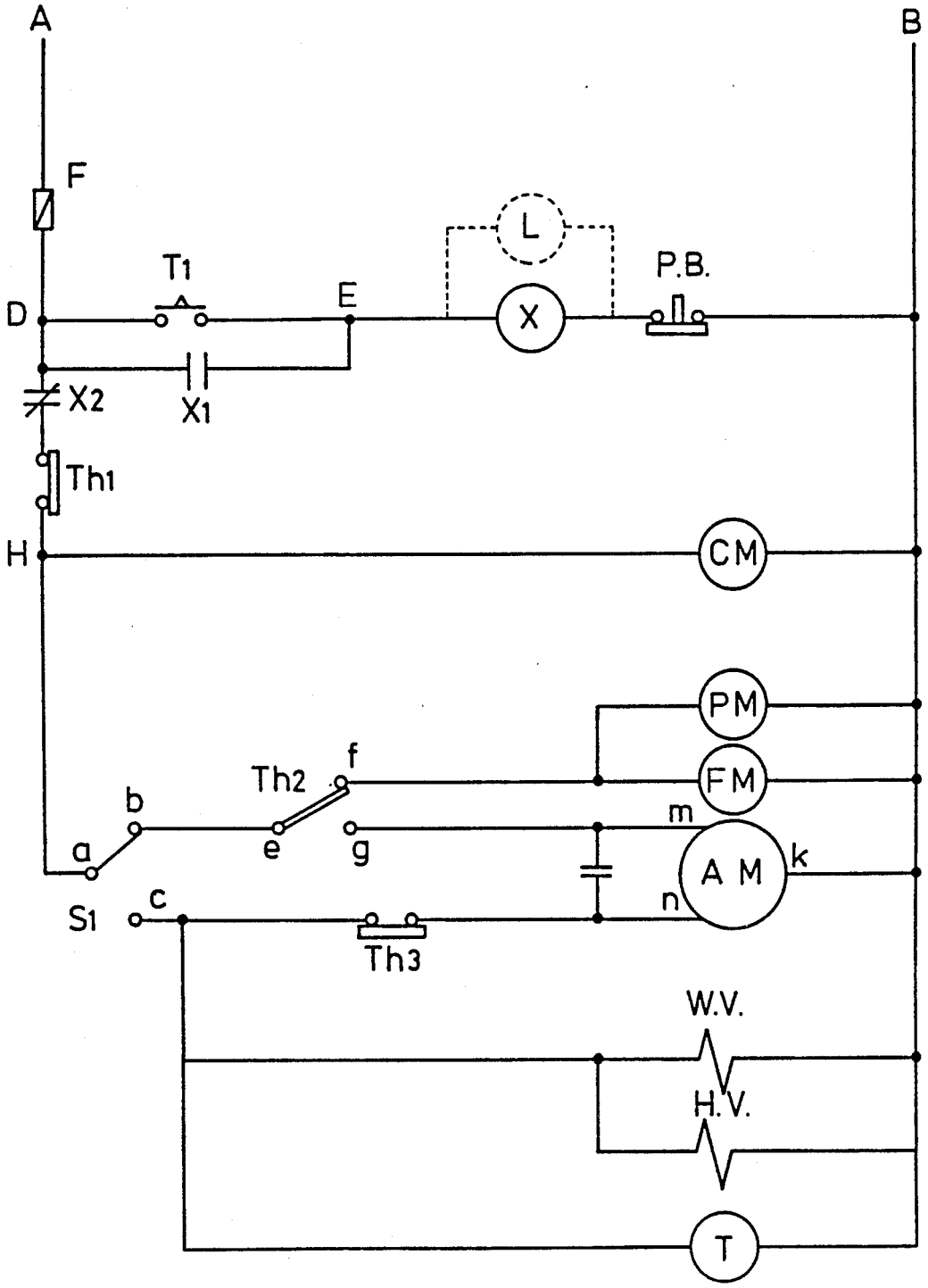
FIG. 3 shows an electric circuit diagram of the automatic ice making machine according to the embodiment.

FIG. 3 shows an example of electric control circuit of the automatic ice making machine according to the above embodiment, wherein a fuse F is disposed between a power supply line A and a connecting point D; and between the connecting point D and another power supply line B serially disposed are a normally open contact $T_1$ for the timer T to be described later, a relay X and a push button PB for causing the resetting motion. The connecting point E connecting the normally open contact $T_1$ with the relay X is connected to the connecting point D through the normally open contact $X_1$ of the relay X. Further, an alarm lamp L is disposed parallel to the relay X as shown with the dotted line, the timer T, the alarm lamp L and the relay X constituting a protection unit.

Between the connecting point D and the connecting point H, a normally closed contact $X_2$ for the relay X and an ice fullness detector $Th_1$ are serially disposed; whereas a compressor CM is disposed between the connecting point H and the power supply line B. The contact a of the change-over switch $S_1$ which is urged to be changed over by the tilting of the water tray when the ice releasing operation is started is connected to the connecting point H, and the contact b of the switch $S_1$ is connected to the contact e of the temperature detector $Th_2$. Between the contact f of this temperature detector $Th_2$ and the power supply line B, disposed in parallel are a fan motor FM for cooling the condenser 21 and a pump motor PM for circulating the water to be frozen. Further, the contact g of the temperature detector $Th_2$ is connected to the power source terminal m for driving the actuator motor AM, which allows the tilting and resetting motion of the water tray 4, to cause the tilting motion; and the other power source terminal k of the actuator motor AM is connected to the power source line B.

The contact c of the change-over switch $S_1$ and the power source terminal n for causing the actuator motor AM to be driven in the resetting direction are connected to each other through a temperature detector $Th_3$; and a hot gas valve HV, a water feed valve WV and a timer T are disposed parallel between the connecting point c and the power supply line B. The time preset in this timer is slightly longer than the time actually required for the normal ice releasing operation and is designed to close the normally open contact $T_1$ for a required period of time when the timer has counted up the preset time counted after the starting point of the energization.

Next, operation of the automatic ice making machine having the above constitution will be described. A power switch (not shown) of the automatic ice making machine is first turned on. Since no ice cake is stored in the ice reservoir 13 at this stage, the ice fullness detector $Th_1$ is closed. Since the contact a of the change-over switch $S_1$ is connected to the contact b, and the temperature of the freezing chamber 1 is substantially at room temperature, the contact e of the temperature detector $Th_2$ is connected to the contact f. Accordingly, as soon as the power switch is turned on, the compressor (CM) 20, fan motor FM and pump motor PM are energized to start ice making operation. Then, the cooling medium and the water to be frozen are circulated as explained above referring to FIGS. 1 and 2, and thus the temperature of the water and that of the freezing chamber 1 are gradually lowered. When the machine is performing normal ice making operation, the temperature of the water circulated becomes 0° C. after a predetermined time from the starting point of the ice making operation to cause ice cakes to grow in the freezing chamber 1.

When the temperature of the freezing chamber 1 drops to a predetermined range after ice cakes are formed, the temperature detector $Th_2$ detects it to connect the contact e to the contact g; whereupon the fan motor FM and the pump motor PM are deenergized and the actuator motor AM is energized to start ice releasing operation. Upon rotation of the actuator motor AM, the water tray 4 and the water tank 5 start to tilt, and at the end of the tilting motion, the contact a of the change-over switch $S_1$ is changed over to the contact c, wherein the temperature detector $Th_3$ assumes an open posture. The changing over of the change-over switch $S_1$ urges the water feed valve WV to be open, whereby another portion of fresh water of normal temperature is supplied to the tank 5 from the external water supply system. With the opening of the hot gas valve HV, the evaporator 3 is warmed to accelerate the ice releasing operation and the timer T starts time counting.

As described above, when the temperature of the freezing chamber 1 has risen after the ice cakes formed in the freezing cells 2 dropped by their own weight, the temperature detector $Th_3$ detects completion of ice removal operation to allow its contact to assume a closed posture. The actuator motor AM is energized when the temperature detector $Th_3$ is closed to start reverse rotation and allow the water tray 4 to return to the original horizontal posture. After completion of the resetting motion, the contact a of the change-over switch $S_1$ is changed over to the contact b to resume the ice making operation and repeat the above procedures, and the timer T is cleared as soon as the power supply thereto is shut off. When a predetermined amount of ice cakes are stored in the ice reservoir 13 after repetition of the ice making operation and the ice releasing operation alternatively for some time, the ice fullness detector switch $Th_1$ is made open to stop the ice making machine.

If any trouble should have occurred when ice releasing operation is started, such as the defect in the opening operation of the hot gas valve HV, failure of resetting the water tray 4 due to the trouble of the actuator motor AM, defect in the contacts due to the trouble of the temperature detector $Th_3$, deficiency of hot gas supply due to the gas leakage within the freezing system circuit, deficient compressing of the cooling medium due to the compressor trouble, and the like, the contact a of the change-over switch $S_1$ remains as connected to the contact c to keep energization of the hot gas valve HV and the water feed valve WV to continue the ice releasing operation and causes breakdown of the compressor and waste of power or water. In this embodiment, however, if the contact a of the change-over switch $S_1$ is left as connected to the contact c, the timer T is also kept energized to keep on the time counting.

As soon as the timer T has counted up the predetermined preset time to close the contact $T_1$, a circuit: power supply line A → fuse F → connecting point D → contact $T_1$ → relay X and alarm lamp L → reset push button PB → power supply line B is formed to energize the relay X and the alarm lamp L, whereby the normally open contact $X_1$ of the relay X is closed and the normally closed contact $X_2$ is made open. By the closing of the normally open contact $X_1$, the continuity of the relay X is retained on its own, and by the opening of the normally closed contact $X_2$ the compressor motor CM, fan motor FM, pump motor PM, hot gas valve HV and water feed valve WV are deenergized to stop the ice making machine.

Accordingly, the automatic ice making machine of this embodiment can prevent not only breakdown of the compressor which occurs in the prior art ice making machine by inhibiting the compressor to repeat the cycle of overload operation and stopping but also waste of power and water effectively. Incidentally, the alarm lamp L disposed parallel to the relay X as shown with the dotted line in FIG. 3 allows the user to find occurrence of some trouble visually. Further, occurrence of trouble may be made known audibly by disposing a means which gives an alarm sound such as a buzzer parallel to the alarm lamp and actuating them at the same time.

When the ice making operation is resumed after a required trouble-shooting is made, the reset push button PB is depressed to make its contact to assume an open posture, or the supply of power is shut off to release the self-retention of the continuity of the relay X.

While the automatic ice making machine according to this invention has been described heretofore by way of a preferred embodiment, this invention is not intended to be limitatively used in the closed cell system ice making machine but in various types of ice making machines of open cell system, flow-down system, etc. On the other hand, while a temperature detecting mode (temperature detector $Th_2$) has been described as an example of the means for detecting the completion of ice formation, this invention can be applied to all of the ice making machines employing any of the timer system, water level detection system, pressure detection system, ice thickness detection system, temperature and timer system, water level and timer system, etc.

In the above preferred embodiment, while a relay X was used as a constituent of the protection unit, the present invention is not limited thereto and it is possible to use electronic parts in combination with the respective detection means or timer.

What is claimed is:

1. An automatic ice making machine having an ice making section equipped with an evaporator connected to a freezing system, a water feed system for feeding a water to be frozen to said ice making section, an ice releasing unit for releasing the ice cakes formed in said ice making section, and an ice removal detector which detects completion of removal of ice cakes in said ice making section;

characterized in that said ice removal detector further comprises a protection unit which stops the ice making operation after a predetermined time counted from the starting point of the ice releasing operation, provided that the ice removal detector outputs no ice removal signal, and wherein:

the protection unit comprises a timer having a normally open contact which is closed when a preset time is counted up thereby, and a relay having a normally closed contact interposed within one of the power supply lines connected to the ice making machine and a normally open contact disposed in parallel to the normally open contact of the timer; and the relay allows its normally closed contact to assume an open posture and also its normally open contact to assume a closed posture when it is energized between the two power supply lines upon closure of the normally open contact of the timer to retain continuity on its own.

2. The automatic ice making machine according to claim 1, wherein the protector unit has an alarm means which is actuated when the ice making operation is suspended.

3. The automatic ice making machine according to any of claims 1 to 2, wherein the protection unit has a means for manually releasing the protection NAB unit to suspend the ice making operation.

4. The automatic ice making machine according to claim 4, wherein the ice removal detector outputs an ice removal completion signal when the temperature of the ice making section rises to a predetermined level.

5. The automatic ice making machine according to claim 3, wherein the ice removal detector comprises a microswitch which outputs an ice removal completion signal upon detection of the dropping state of the released ice cakes.

6. The automatic ice making machine according to any of claims 1 to 2, wherein the ice removal detector outputs an ice removal completion signal when the temperature of the ice making section rises to a predetermined level.

7. The automatic ice making machine according to any of claims 1 to 2, wherein the ice removal detector comprises a microswitch which outputs an ice removal completion signal upon detection of the dropping state of the released ice cakes.

8. An automatic ice making machine comprising:

an ice making section equipped with an evaporator connected to a freezing system;

a water feed system for feeding a water to be frozen to said ice making section;

an ice removing unit for removing ice cakes formed in said ice making section; and an ice removal detector which detects completion of removal of ice cakes in said ice making section and reversely energizes said ice removing unit;

said machine having a protection unit comprising:

a timer unit provided with a normally open contact which is closed when a predetermined time period is counted up, said predetermined time period being set to be longer than a prospective time period between a start of ice removal and a completion of ice removal; and a relay provided with a normally closed contact interposed within one of said power supply lines which is connected to an electrical system of said freezing system and with a normally open contact connected parallel to said normally open contact of said timer; and when said timer unit is counted up within said perspective time period between the start of ice removal and completion thereof without an ice removal completion signal outputted by said ice removal detector, said relay is energized by said normally open contact being closed so that said normally closed contact of said relay is opened to stop the ice making operation and to close said normally open contact for self-retention of continuity of said relay.

* * * * *